United States Patent [19]

Ekberg

[11] 3,996,777

[45] Dec. 14, 1976

[54] PRESS BRAKE WORK PIECE ALIGNMENT APPARATUS

[75] Inventor: Rolf Ekberg, Chicago, Ill.

[73] Assignee: Lawrence Peska Associates, Inc., New York, N.Y. ; a part interest

[22] Filed: Jan. 19, 1976

[21] Appl. No.: 649,929

[52] U.S. Cl. ..... 72/36; 72/389; 72/461; 83/254; 83/393; 83/468

[51] Int. Cl.[2] ..... B21D 11/22

[58] Field of Search ..... 72/36, 32, 461, 380, 72/385, 386, 389, 35; 83/254, 393, 468

[56] References Cited

UNITED STATES PATENTS

| | | | |
|---|---|---|---|
| 869,309 | 10/1907 | Kramer | 83/468 |
| 1,110,810 | 9/1914 | McDonald | 83/254 |
| 3,704,611 | 12/1972 | Hirsch | 72/36 |
| 3,812,695 | 5/1974 | Roch | 72/461 |
| 3,826,119 | 7/1974 | Marotto | 72/461 |

*Primary Examiner*—C.W. Lanham
*Assistant Examiner*—Gene P. Crosby

[57] ABSTRACT

This disclosure pertains to a press brake work piece alignment apparatus comprising an alignment shoe mounting plate adjustably secured to a supporting surface of a press brake adapted with a plurality of threaded holes transverse to the longitudinal axis of the forming dies. Bolts adjustably secure alignment shoes to the shoe mounting plate through longitudinal slots therein. One or more of the alignment shoes are hinged on a pivot axis transverse to the longitudinal axis of the forming dies, such that they can be selectively unfolded into a work piece alignment position for each sequential bending operation. Alternatively, a non-hingable alignment shoe may be utilized to initially position the work piece by locating a free edge thereof along the alignment edge of the alignment shoe. A calibrating scale assists in positioning the alignment shoes at predetermined locations upon the shoe mounting plate.

8 Claims, 3 Drawing Figures

PRESS BRAKE WORK PIECE ALIGNMENT APPARATUS

BACKGROUND OF THE INVENTION

1. The Field of the Invention

This invention relates to press brake work piece alignment devices and more particularly to that class which sequentially locate the position of an edge of the work which is parallel to the longitudinal forming dies.

2. Description of the Prior Art

The prior art in the main depends upon the production concept of an alignment device which is adapted to align the work piece to a single alignment position permitting a large quantity of work pieces to be handled sequentially in which a single bend is formed on each work piece. The alignment apparatus is reset preceeding a subsequent series of bending operations in which the work pieces are again individually handled in performing a second bending operation. Such an apparatus, because of its inability to permit a number of successive bends on one work piece, requires each individual work piece to be brought to the bending machine for a single bend, thereby increasing production costs.

SUMMARY OF THE INVENTION

The invention comprises a work piece alignment apparatus having a plurality of alignment shoes. Each alignment shoe has a longitudinal slot therethrough through which a bolt passes, securing the shoe to threaded holes in an alignment shoe mounting plate. The alignment shoe mounting plate is mounted to a mounting surface of a press brake by utilizing bolts passing through knotches at one edge thereof such that the mounting plate can be adjusted in a direction parallel to the axis of the forming dies of the brake. The longitudinal axes of the slots are normal to the alignment edges of the shoes utilized to locate an edge of the work piece an adjustable distance from the bend line to be formed therein. The position of the alignment shoe along the shoe mounting plate is adjusted by shifting the shoes along the length of the slot. The alignment shoes are of two varieties, one of which is a one piece alignment shoe having an alignment edge extending beyond the edges of the shoe mounting plate. The hinged variety of alignment shoe comprises a stationary portion thereof clampingly fastened to the alignment shoe mounting plate by utilizing a bolt passing through the slot located therein. A second portion is pivotably secured along a pivot axis located at one edge of the alignment shoe which extends vertically from the longitudinal axis of the forming dies. The second portion can be stored in one of two positions. The unused position is where the second portion is folded atop the first portion while in the use position the second portion is pivoted upwards and outwards from the shoe mounting plate such that the alignment edge extends beyond the peripheral edges of the mounting plate.

A pivotable alignment shoe is unfolded into the use position preceeding each bending operation, locating thereby an edge of the work piece in the correct location relative to the longitudinal axis of the forming dies. This precludes the requirement of running a quantity of work pieces in performing a single bending operation since a single work piece can be properly sequentially located for a number of successive bending operations in one handling operation by sequential outward pivoting of pivotable alignment shoes.

A calibrating scale may be located on an exposed lateral surface of the shoe mounting plate having its length parallel to the longitudinal axis thereof. A mating calibrating scale on an exposed lateral surface of each alignment shoe permits vernier calibration of the locating position of the alignment edge of each shoe.

More than one work piece alignment apparatus may be employed on a press brake. Two such devices placed on one side of the forming dies permits the user to provide a longer alignment edge by allowing two opposing alignment shoes to have their alignment edges coaxially aligned, or to allow the alignment edge of the work piece to be located an incremental distance from a pervious location less than the width of an alignment shoe. The user would alternately employ one alignment apparatus after another to provide alignment edges whose axes are closely spaced. The forming dies may be located between two or more work piece alignment devices. This allows the user to utilize opposite edges of the work piece permitting complex sequential bending operations.

A primary object of the instant invention is to provide an apparatus which can rapidly align sheet stock to be formed by locating an external edge thereof at an alignment edge of an adjustable alignment shoe.

Another object is to provide a number of alignment edges that can be selectively employed to quickly reposition the work sheet after preceeding bending operations.

Still another object is to provide an apparatus which can align a work sheet relative to more than one edge thereof.

A further object is to provide alignment edges which can be infinitely variably positioned a selected distant range from the forming dies.

Yet another object is to provide an alignment edge which can be stored at a remote location to the work sheet when not in use.

These objects, as well as other objects of this invention, will become readily apparent after reading the following description of the accompanying drawings.

DESCRIPTION OF THE PREFERRED EMBODIMENT

Figure 1:
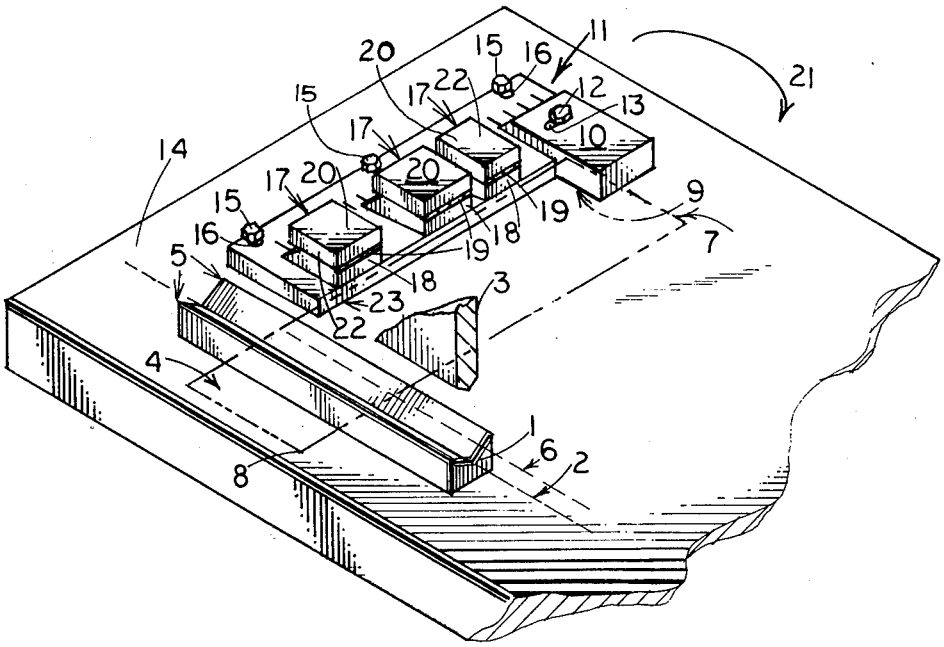
FIG. 1 is a perspective view of the press brake work piece alignment apparatus shown mounted on a machine bed, aligning an edge of a work piece relative to a forming die set.

The structure and method of fabrication of the present invention is applicable to a press brake work piece alignment apparatus adapted to align an edge of a work piece to a parallel position relative to the longitudinal axis of brake forming dies. A longitudinal lateral alignment shoe mounting plate is affixed to the structure of a brake such that one longitudinal edge of the alignment shoe mounting plate is transverse to the longitudinal axis of the forming dies. The shoe mounting plate is adjustably secured to the brake structure or machine bed by bolts passing through knotches located in the opposite longitudinal edge thereof. A plurality of holes in the machine bed or structure permits the shoe mounting plate to be secured optionally at any location desired along the length of the forming dies. Minor longitudinal adjustments are accomplished by locating the shoe mounting plate along the various positions obtained by the mounting bolts passing through the length of the mounting knotches.

A series of threaded holes are located along a line parallel to one of the longitudinal edges of the shoe mounting plate. Each alignment shoe is provided with at least one slot therein whose length is somewhat greater than the spacing between adjacent threaded holes in the shoe mounting plate. A bolt passing through the slot secures the alignment shoe to the mounting plate and in the loosened position permits a longitudinal adjustment of the alignment shoe. When the length of the slot prevents further longitudinal displacement of the alignment shoe, the bolt is removed and repositioned into an adjacent threaded hole permitting further longitudinal adjustment of the shoe. Continual stepwise progressions of bolt locations interspersed with slidable adjustment of the shoe for the length of the slot permits a shoe to be located at any desired point along the length of the shoe mounting plate.

The shoes may be of two varieties. A one piece shoe extends perpendicularly beyond the edge of the shoe mounting plate for a finite distance. The edge of the shoe closest to the forming dies constitutes an alignment edge for a bending operation in which the edge of the work sheet is to be located the greatest distance from the centerline of the forming dies. The work sheet may have its alignment edge in touching contact with the alignment edge of the one piece shoe while an adjacent edge is in contact with a longitudinal edge of the shoe mounting plate. Thus the work sheet or bar is positioned along two transverse edges for the alignment operation in which the one piece alignment shoe is utilized.

Subsequent bending operations may utilize a hinged variety of alignment shoe to accomplish locating the alignment edge of the work sheet at positions intermediate the location of the alignment edge of the one piece variety alignment shoe and the adjacent edge of the forming dies. This style of shoe must be maintained clear of the area occupied by the work piece until such time that the alignment edge of the work piece is relocated to an aforementioned intermediate position. The hinge function of this style alignment shoe permits the two pieces making up the shoe to be stored directly over the shoe mounting plate when the alignment shoe is not being utilized. The movable portion is pivotably rotated about a pivot line located parallel to and slightly above the alignment edge of the shoe mounting plate. When the movable portion of the alignment shoe is allowed to extend beyond the alignment edge of the shoe mounting plate, the edge thereof closest to the forming dies makes up a new alignment edge for locating the work sheet. A stationary portion of the hinged style alignment shoe is secured to the shoe mounting plate utilizing at least one slot in the same manner as the one piece style alignment shoe. The slot may be recessed to accommodate the head of the mounting bolt permitting the movable portion of the shoe to lie directly on the uppermost exposed surface of the stationary portion when the movable portion is in the stored position. A number of hinged style alignment shoes will provide an equivalent number of locating alignment edges permitting the user to manually or automatically transport the work piece perpendicularly to the longitudinal axis of the forming dies between each forming operation, during which time the work piece, if desired, may be inverted permitting thereby a flexible multi-step bending process in a work piece that has been brought to the press brake without requiring time consuming rejigging between successive bends.

The alignment shoe has a discreet width as required by the structural strength which is necessary to provide a rigid accurate alignment edge. The situation often arises in which the alignment edge of the work sheet must be located at a distance less than the width of an alignment shoe. Since the available alignment edges of adjacent hinged style alignment shoes are spaced apart minimally a distance equal to the width of an alignment shoe and the distance seperating adjacent edges thereof, the work piece would not be able to be successively positioned a smaller distance for subsequent bends. This objection is overcome by mounting a second shoe mounting plate to a mounting surface of the press brake at a location on the same side of the forming dies as the first shoe mounting plate or, on the opposite side of the forming dies or both. In the case that both shoe mounting plates are located on one side of the forming dies, the same alignment edge, parallel to the longitudinal axis of the forming dies, may be successfully aligned at any intermediate location, independent of the width of an alignment shoe, by alternate utilization of alignment shoes on each of the shoe mounting plates. In the case that a shoe mounting plate is located on each side of the forming dies, opposing parallel edges of the work piece are positioned by the alignment edges of opposite alignment shoes permitting infinite adjustment in the alignment location preparatory to bending of the work piece thereby.

The utilization of left handed and right handed shoe mounting plates for convenient mounting in adjacent or opposite locations relative to the forming dies is facilitated by locating a scale suitably numerically identified on an exposed lateral surface, in opposite reading directions, upon each variety of shoe mounting plate. An adjacent edge of both style alignment shoes may bear either an alignment line transverse to the axis of the stationary scale or a plurality of lines comprising a vernier scale, permitting thereby, vernier adjustment of the alignment shoes. The thickness of alignment shoes may vary dependent upon the type of work sheet alignment edge to be aligned thereby. If a work piece has been once bent, the surface displaced from the lateral work sheet surface may subsequently be utilized as an alignment edge by locating it in contact with a thick variety of alignment shoe.

Now referring to the Figures, and more particularly to the embodiment illustrated in FIG. 1 showing a lowermost forming die 1 whose longitudinal axis is depicted by line 2. An upper forming die 3 is fragmentally illustrated over a work sheet or bar 4 located over the lowermost forming die 1. The work sheet 4 may rest upon edges 5 of the lowermost forming die. When the uppermost forming die 3 descends and contacts the work sheet 4, bending takes place along a line 6 in the work sheet whereby an alignment edge 7 and the free edge 8 are elevated above the initial plane of the work sheet. Alignment edge 7 is located along a vertical surface 9 of a one piece alignment shoe 10. Surface 9 constitutes an alignment edge for the edge 7 of the work sheet 4. Alignment shoe 10 is rigidly adjustably secured to a shoe mounting plate 11 by bolt 12 passing through a slot 13 therein. Shoe mounting plate 11 is clampingly secured to a machine bed 14 by bolts 15 passing through knotches 16, so that the shoe mounting plate 11 may be adjusted in a direction parallel to line 2. Hinge style alignment shoes 17 are mounted to shoe mounting plate 11 by a stationary portion thereof 18. Hinges 19 permit a movable portion 20 of each hinge style alignment shoe 17 to be pivotably hingably rotated thereabout in the direction of curved arrow 21 permitting a face 22 to be extended outwardly from the shoe mounting plate 11 beyond the longitudinal alignment edge 23 of the shoe mounting plate.

Figure 2:
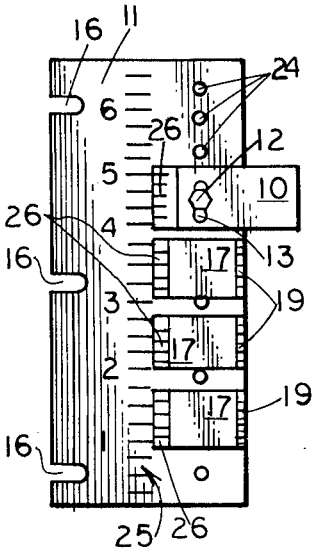
FIG. 2 is a plan view of a right handed press brake work piece alignment apparatus.

FIG. 2 illustrates knotches 16 in the shoe mounting plate 11 as well as a plurality of threaded holes 24 adapted to receive alignment shoe securing bolts 12. Slot 13 in the one piece alignment shoe 10 is of greater length than the distance between adjacent threaded holes 24. Hinged style alignment shoes 17 are shown in the stored position pivotably secured thereat by the hinge style pivot mechanism 19. A calibrated distance scale 25 is located on an exposed lateral surface of the shoe mounting plate 11 to which the vernier scale 26 located on the alignment shoes abut.

Figure 3:
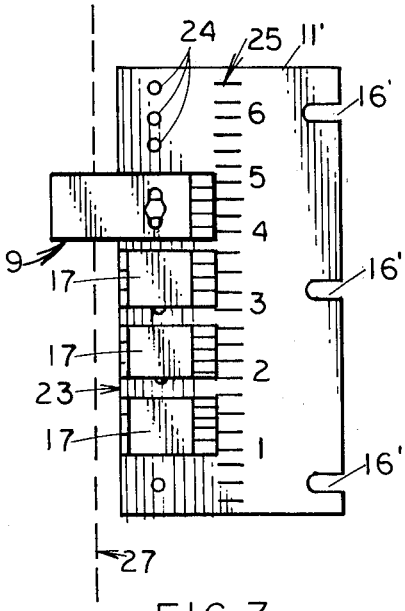
FIG. 3 is a plan view of a left handed press brake work piece alignment apparatus.

FIG. 3 depicts the shoe mounting plate 11' upon which scale 25 is located. Knotches 16' are located in mirror image fashion about line 27 as compared to their location in the shoe mounting plate 11 depicted in FIG. 1. Alignment edge 9 may be located at a slightly varient distance from the forming dies, not shown, as compared to a closely positioned alignment location obtained by an alignment edge on either style alignment shoe secured to a mirror image type shoe mounting plate located on the same side of the forming dies.

FIGS. 2 and 3, as shown, indicate the relative mounting positions of two shoe mounting plates and their respective alignment shoes when both are utilized on one side of the forming dies. The shoe mounting plate and alignment shoes depicted in FIG. 3 may, alternatively, be secured on the side opposite the mounting side of the shoe mounting plate as shown in FIG. 2. In either application, shoe mounting plate alignment edge 23 may be utilized to align the edge of the work piece transverse to the bending line 6 as shown in FIG. 1.

One of the advantages is an apparatus which can rapidly align sheet stock to be formed by locating an external edge thereof at an alignment edge of an adjustable alignment shoe.

Another advantage is a number of alignment edges that can be selectively employed to quickly reposition the work sheet after preceeding bending operations.

Still another advantage is an apparatus which can align a work sheet relative to more than one edge thereof.

A further advantage is alignment edges which can be infinitely variably positioned a selected distant range from the forming dies.

Yet another advantage is an alignment edge which can be stored at a remote location to the work sheet when not in use.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims.

I claim:

1. In a press brake machine comprising a stationary lowermost forming die, an uppermost forming die, longitudinal opposing surfaces of said uppermost and lowermost forming dies adapted to form a bend in a portion of the surface of a work material located therebetween along a longitudinal line, the improvement comprising:

a. means to adjustable fixedly secure a first alignment shoe along the longitudinal axis of a longitudinal shoe mounting plate, said first alignment shoe having an alignment edge thereof parallel to said longitudinal line and perpendicular to said longitudinal axis, b. means to adjustably fixedly secure a first portion of a second alignment shoe to said shoe mounting plate along said longitudinal axis thereof, a second portion of said second alignment shoe secured to said first portion along a pivot axis line parallel to said longitudinal axis and an alignment edge of said second portion perpendicular to said axis, c. means to adjustably fixedly secure a mounting surface of said shoe mounting plate upon a supporting surface of said press brake machine.

2. The improvement as recited in claim 1, in which means (a) comprises a plurality of tapped holes in said shoe mounting plate located along a line parallel to said axis adapted to threadingly engage external threads of a bolt passing through a longitudinal slot in said first alignment shoe, said longitudinal slot having a longitudinal axis perpendicular to said line, the head of said bolt securing a lateral surface of said first alignment shoe to said shoe mounting plate.

3. The improvement as recited in claim 1, in which means (b) comprises a plurality of tapped holes in said shoe mounting plate located along a line parallel to said axis adapted to threadingly engage external threads of a bolt passing through a longitudinal slot in said first portion of said second alignment shoe, said longitudinal slot having a longitudinal axis perpendicular to said line, the head of said bolt securing a lateral surface of said first portion of said second alignment shoe to said shoe mounting plate.

4. The improvement as recited in claim 1, in which means (a) further comprises a calibrated distance indicating scale located upon a lateral exposed surface of said shoe mounting plate having calibrating lines thereupon parallel to said line, a vernier calibrating scale upon a lateral exposed surface of said first alignment shoe having vernier calibrating lines thereupon adjacent to the lines of said distance indicating scale.

5. The improvement as recited in claim 1, in which means (b) further comprises a calibrated distance indicating scale located upon a lateral exposed surface of said shoe mounting plate having calibrating lines thereupon parallel to said line, a vernier calibrating scale upon a lateral exposed surface of said first portion of said second alignment shoe having vernier calibrating lines thereupon adjacent to the lines of said distance indicating scale.

6. The improvement as recited in claim 1, in which means (c) comprises at least one notch located along a longitudinal edge of said shoe mounting plate having a longitudinal axis parallel to said line, a bolt passing through a portion of said notch having an external thread thereupon threadingly engaging a threaded hole within said supporting surface.

7. The improvement as recited in claim 1 wherein two of said shoe mounting plates are adjustably fixedly secured upon said supporting surface, a first alignment shoe adjustably fixedly secured upon each of said two shoe mounting plates such that each of said alignment edges thereof are in axial alignment.

8. The improvement as recited in claim 3 wherein said head of said bolt is totally recessed within said first portion of said second alignment shoe.

* * * * *